US007443391B2

(12) United States Patent
Yoneyama

(10) Patent No.: US 7,443,391 B2
(45) Date of Patent: Oct. 28, 2008

(54) CURRENT DRIVE CIRCUIT AND DISPLAY

(75) Inventor: Teru Yoneyama, Kawasaki (JP)

(73) Assignee: NEC Electronics Corporation, Tokyo (JP)

( * ) Notice: Subject to any disclaimer, the term of this patent is extended or adjusted under 35 U.S.C. 154(b) by 976 days.

(21) Appl. No.: 10/801,819

(22) Filed: Mar. 17, 2004

(65) Prior Publication Data

US 2004/0189275 A1 Sep. 30, 2004

(30) Foreign Application Priority Data

Mar. 24, 2003 (JP) ..... 2003-080098

(51) Int. Cl.
*G09G 5/00* (2006.01)

(52) U.S. Cl. ..... 345/213; 345/211; 345/212; 345/36; 345/82

(58) Field of Classification Search ..... 345/211–213, 345/36, 82
See application file for complete search history.

(56) References Cited

U.S. PATENT DOCUMENTS 5,796,767 A * 8/1998 Aizawa ..... 372/38.02

FOREIGN PATENT DOCUMENTS

| | | | |
|---|---|---|---|
| CN | 1388503 | A | 1/2003 |
| JP | 2001-42827 | A | 2/2001 |
| JP | 2002-351430 | A | 12/2002 |
| JP | 2003-66906 | A | 3/2003 |

* cited by examiner

*Primary Examiner*—Richard Hjerpe
*Assistant Examiner*—Leonid Shapiro
(74) *Attorney, Agent, or Firm*—Sughrue Mion, PLLC

(57) ABSTRACT

A current drive circuit is provided with a bias generator and a current output unit; wherein the bias generator is provided with: p-channel MOS transistor, p-channel MOS transistor, and reference current source; and the current output unit is provided with: p-channel MOS transistor, switch means, p-channel MOS transistor, and output terminal.

20 Claims, 8 Drawing Sheets

| D3 D2 D1 | switch means that are ON | IOUT |
|---|---|---|
| 0 0 0 | no switch means | 0 |
| 0 0 1 | SW11, SW31, SW51, SW71 | IREF |
| 0 1 0 | SW12, SW22, SW32, SW52, SW62, SW72 | 2IREF |
| 0 1 1 | SW11, SW12, SW22, SW31, SW32, SW51, SW52, SW62, SW71, SW72 | 3IREF |
| 1 0 0 | SW13, SW23, SW33, SW43, SW53, SW63, SW73 | 4IREF |
| 1 0 1 | SW11, SW13, SW23, SW31, SW33, SW43, SW51, SW53, SW63, SW71, SW73 | 5IREF |
| 1 1 0 | SW12, SW13, SW22, SW23, SW32, SW33, SW43, SW52, SW53, SW62, SW63, SW72, SW73 | 6IREF |
| 1 1 1 | SW11, SW12, SW13, SW22, SW23, SW31, SW32, SW33, SW43, SW51, SW52, SW53, SW62, SW63, SW71, SW72, SW73 | 7IREF |

CURRENT DRIVE CIRCUIT AND DISPLAY

BACKGROUND OF THE INVENTION

1. Field of the Invention

The present invention relates to a current drive circuit and display, and more particularly to a current drive circuit of organic EL elements and display.

2. Description of the Related Art

Since the luminance of emitted light in an organic EL element is determined by the drive current, a current drive can better eliminate variation in the luminance of emitted light than a voltage drive in a display in which a plurality of organic EL elements is arranged in a matrix. Conventionally, a configuration such as shown in FIG. 1 is employed as the current drive circuit of organic EL elements. FIG. 1 is a circuit diagram of a current drive circuit of the prior art. As shown in FIG. 1, the current drive circuit of the prior art is provided with: p-channel MOS transistor M01, p-channel MOS transistor M11, reference current source I1, switch means SW1, and output terminal O1; organic EL element Z1 being connected to output terminal O1 as load. In addition, p-channel MOS transistor M01 and p-channel MOS transistor M11 constitute a current mirror circuit, whereby the current IREF that is generated by reference current source I1 is returned from high level power supply VDD and supplied by way of switch means SW1 to organic EL element Z1 that is connected to output terminal O1. Switch means SW1 is consisted of, for example, a p-channel MOS transistor and is ON/OFF controlled by one-bit graduation data signal D1. When switch means SW1 is turned ON, a prescribed return current of the current drive circuit is supplied as drive current IOUT to organic EL element Z1, whereby organic EL element Z1 is illuminated; and when switch means SW1 is turned OFF, drive current IOUT becomes 0 and organic EL element Z1 is extinguished. A similar configuration that employs a bipolar transistor is disclosed in FIG. 7 of Japanese Patent Laid-Open Publication No. 2001-042827.

However, the current drive circuit of the example of the prior art that is shown in FIG. 1 is a configuration in which switch means SW1 is connected between output terminal O1 and the drain terminal of p-channel MOS transistor M11, which is the output terminal of a current mirror circuit. As a result, when switch means SW1 is in the OFF state, the voltage between node A and node B of switch means SW1 is substantially the voltage difference between voltage VDD on the high level power supply VDD and ground, i.e., the low level power supply. In other words, the voltage difference is at an extremely high level that approaches voltage VDD, and the problem therefore arises that a large surge current is generated such as shown in FIG. 2 when switch means SW1 changes from the OFF state to the ON state. As an additional problem, the use of the basic current mirror circuit in the current drive circuit of the example of the prior art shown in FIG. 1 prevents the acquisition of a highly accurate return current.

SUMMARY OF THE INVENTION

The present invention was realized in view of the above-described problems and has as an object the provision of a current drive circuit that is capable of both obtaining a highly accurate drive current and suppressing the occurrence of a surge current, and further, to provide a display that is provided with such a current drive circuit.

The current drive circuit of the present invention is provided with: a current mirror circuit; a current source for applying reference current input to the current mirror circuit; a switch means to which the output current of the current mirror circuit is applied; and a cascode circuit for supplying the output current of the switch means as a drive current.

In addition, the current drive circuit of the present invention is provided with a bias generator that includes: a first transistor in which the gate terminal and drain terminal are connected together; a second transistor in which the source terminal is connected to the drain terminal of the first transistor and in which the gate terminal and drain terminal are connected together; and a current supply that causes a reference current to flow to the second transistor; and a current output unit that includes: a third transistor in which the gate terminal is connected to the gate terminal of the first transistor; a fourth transistor in which the gate terminal is connected to the gate terminal of the second transistor; and a switch means that is provided between the drain terminal of the third transistor and the source terminal of the fourth transistor. In addition, a plurality of current output units, and a plurality of terminals that are connected to each of the drain terminals of the fourth transistors of the plurality of current output units may also be provided.

Each of the plurality of current output units may supply as output a current that has been weighted.

A plurality of the current drive circuits of the present invention and a terminal that is connected to the drain terminals of each of the fourth transistors of the plurality of current drive circuits may also be provided.

Each of the plurality of current drive circuits may supply as output a current that has been weighted.

The switch means may be turned ON and OFF by a control signal.

The control signals may be graduation data signals of a display.

The switch means may be a MOS transistor.

The switch means may be a switch group that includes a plurality of switch means, and the switch group may decode the graduation data signals of the display.

A switch means that is connected to the source terminal of the third transistor may also be provided.

A switch means may also provided that is connected to the source terminal of the first transistor and that is always in the ON state.

The display of the present invention is provided with: organic EL elements that are arranged in a matrix; current drive circuits and scan circuits for causing drive currents to flow to the organic EL elements; and signal processing circuits for receiving image data signals as input, supplying graduation data signals as output to the current drive circuits, and supplying scan control signals as output to the scan circuits; and is provided with the above-described current drive circuit as a current drive circuit.

Accordingly, the present invention can realize a current drive circuit that is capable of obtaining a highly accurate drive current, and further, of suppressing the occurrence of a surge current, and that can realize a display that is provided with such current drive circuits.

The above and other objects, features, and advantages of the present invention will become apparent from the following description with reference to the accompanying drawings, which illustrate examples of the present invention.

DETAILED DESCRIPTION OF THE PREFERRED EMBODIMENTS

Figure 3:
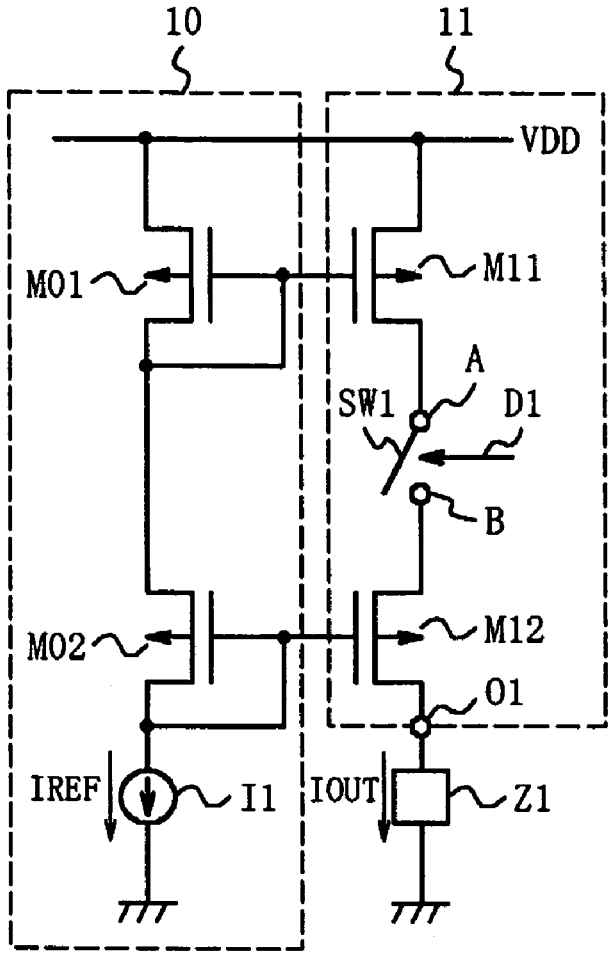
FIG. 3 is a circuit diagram of the current drive circuit of the first embodiment of the present invention.

Embodiments of the present invention are next described with reference to the accompanying drawings. First, referring to FIG. 3, the configuration of the current drive circuit of the first embodiment of the present invention is described. FIG. 3 is a circuit diagram of the current drive circuit of the first embodiment of the present invention. As shown in FIG. 3, the current drive circuit of the first embodiment of the present invention is provided with bias generator 10 and current output unit 11.

Bias generator 10 is provided with: p-channel MOS transistor M01, p-channel MOS transistor M02, and reference current source I1. The source terminal of p-channel MOS transistor M01 is connected to high level power supply VDD, and the gate terminal of p-channel MOS transistor m01 and the drain terminal of p-channel MOS transistor m01 are connected together. The source terminal of p-channel MOS transistor M02 is connected to the drain terminal of p-channel MOS transistor M01, and the gate terminal of p-channel MOS transistor M02 and the drain terminal of p-channel MOS transistor M02 are connected together. Reference current source I1 is connected between the drain terminal of p-channel MOS transistor M02 and the ground, which serves as the low level power supply, and supplies constant current IREF to p-channel MOS transistor M02.

Current output unit 11 is provided with: p-channel MOS transistor M11, switch means SW1, p-channel MOS transistor M12, and output terminal O1. The source terminal of p-channel MOS transistor M11 is connected to the high level power supply VDD, and the gate terminal of p-channel MOS transistor M11 is connected to the gate terminal of p-channel MOS transistor M01. The gate terminal of p-channel MOS transistor M12 is connected to the gate terminal of p-channel MOS transistor M02, and the drain terminal of p-channel MOS transistor M12 is connected to output terminal O1. Switch means SW1 is provided between the drain terminal of p-channel MOS transistor M11 and the source terminal of p-channel MOS transistor M12. In other words, node A, which is one end of the ON/OFF path of switch means SW1, is connected to the drain terminal of p-channel MOS transistor M11, and node B, which is the other end of the ON/OFF path of switch means SW1, is connected to the source terminal of p-channel MOS transistor M12. Switch means SW1 is consisted of, for example, a p-channel MOS transistor, the source-drain path of this p-channel MOS transistor being the ON/OFF path of switch means SW1 and one-bit graduation data signal D1 being applied to the gate terminal of this p-channel MOS transistor. Switch means SW1 is turned ON and OFF by graduation data signal D1, which is the ON/OFF control signal. Organic EL element Z1 is then connected as load between output terminal O1 and ground.

Following explanation regards the operation. P-channel MOS transistor M01 and p-channel MOS transistor M11 operate as a current mirror circuit, p-channel MOS transistor M02 and p-channel MOS transistor M12 operate as a cascode circuit, and reference current source I1 operates by applying constant current IREF as input to p-channel MOS transistor M01 of the current mirror circuit by way of p-channel MOS transistor M02 of the cascode circuit. In this example, the channel length and channel width of p-channel MOS transistor M01 and p-channel MOS transistor M11 are identical, and the channel length and channel width of p-channel MOS transistor M02 and p-channel MOS transistor M12 are identical, but the channel length and channel width ratio of p-channel MOS transistor M01 and p-channel MOS transistor M11 may be altered to change the mirror ratio. Further, although the channel length and channel width of p-channel MOS transistor M01 and p-channel MOS transistor M02 are identical in this example, the channel length and channel width for the two p-channel MOS transistors M01 and M02 need not be identical. When constant current IREF is applied as input to p-channel MOS transistor M01 of the current mirror circuit, a current that is in units of constant current IREF is returned from p-channel MOS transistor M11 of the current mirror circuit and applied as input to switch means SW1. When graduation data signal D1 becomes logic L level and switch means SW1 turns ON, the output current of p-channel MOS transistor M11 of the current mirror circuit is supplied from switch means SW1 and applied as input to p-channel MOS transistor M12 of the cascode circuit, and p-channel MOS transistor M12 of the cascode circuit supplies the output current of switch means SW1 to output terminal O1 as drive current IOUT to illuminate organic EL element Z1. When graduation data signal D1 becomes logic H level and switch means SW1 is turned OFF, the output current of p-channel MOS transistor M11 of the current mirror circuit is cut off by switch means SW1, drive current IOUT that p-channel MOS transistor M12 of the cascode circuit supplies to output terminal O1 becomes 0, and organic EL element Z1 is extinguished.

Following explanation regards the voltage difference between node A and node B of switch means SW1 when switch means SW1 is in the OFF state. Constant current IREF flows from reference current source I1 to both p-channel MOS transistor M01 and p-channel MOS transistor M02, p-channel MOS transistor M01 and p-channel MOS transistor M02 both operate in a saturated region, and the relations shown by following equations 1 and 2 can therefore be obtained if $\beta=\mu\cdot COX$. Here, $\mu$ is the carrier mobility, COX is the gate oxide film capacitance, $\lambda$ is the channel modulation effect coefficient, and L and W are the channel length and channel width of p-channel MOS transistor M01 and p-channel MOS transistor M02. Further, VTH1 represents the absolute value of the threshold voltage of p-channel MOS transistor M01, VGS1 is the absolute value of the voltage across the gate and source of p-channel MOS transistor M01, VDS1 is the absolute value of the voltage across the drain and source of p-channel MOS transistor M01, VTH2 is the absolute value of the threshold voltage of p-channel MOS transistor M02, VGS2 is the absolute value of the voltage across the gate and source of p-channel MOS transistor M02, and VDS2 is the absolute value of the voltage across the drain and source of p-channel MOS transistor M02. In the following equations, . indicates multiplication, / indicates division, a^b indicates the bth power of a, and $\sqrt{(a)}$ indicates the square root of a.

$$IREF=(1/2)\cdot\beta\cdot(W/L)\cdot(VGS1-VTH1)\hat{}2\cdot(1+\lambda\cdot VDS1)$$
(Where $VGS1=VDS1$) Equation 1

$$IREF=(1/2)\cdot\beta\cdot(W/L)\cdot(VGS2-VTH2)\hat{}2\cdot(1+\lambda\cdot VDS2)$$
(Where $VGS2=VDS2$) Equation 2

The value of channel modulation effect coefficient λ is extremely small, and if this value is ignored in the interest of simplifying the explanation, equation 1 and equation 2 can be modified and the voltage across the gate-source of p-channel MOS transistor M01 and p-channel MOS transistor M02 can be represented as shown in the following equation 3 and equation 4.

$$VGS1=VTH1+\sqrt{((2IREF/\beta)\cdot(L/W))} \quad \text{Equation 3}$$

$$VGS2=VTH2+\sqrt{((2IREF/\beta)\cdot(L/W))} \quad \text{Equation 4}$$

If the voltage of node A when switch means SW1 is in the OFF state is VA and the voltage of node B when switch means SW1 is in the OFF state is VB, then voltage VA is substantially equal to the voltage VDD of high level power supply VDD, and the threshold voltage of p-channel MOS transistor M12 is equal to threshold voltage VTH2 of p-channel MOS transistor M02, whereby threshold voltage VB becomes a voltage that is higher than the gate voltage of p-channel MOS transistor M02, i.e., (VDD−VGS1−VGS2), and lower than a voltage that is higher by VTH2 than the gate voltage of p-channel MOS transistor M02, i.e., (VDD−VGS1−VGS2+VTH2). In other words, based on equation 3 and equation 4, the maximum of the voltage difference (VA−VB) of switch means SW1 can be approximated by equation 5 below.

$$VA-VB=VTH1+VTH2+2\sqrt{((2IREF/\beta)\cdot(L/W))} \quad \text{Equation 5}$$

Figure 1:
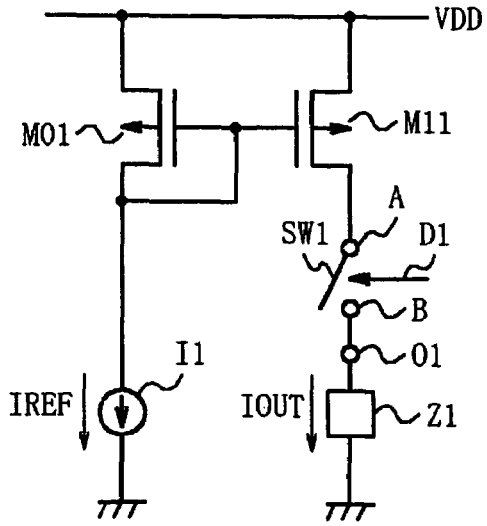
Fig. 1 (Prior Art)
FIG. 1 is a circuit diagram of a current drive circuit of the prior art.
Figure 2:
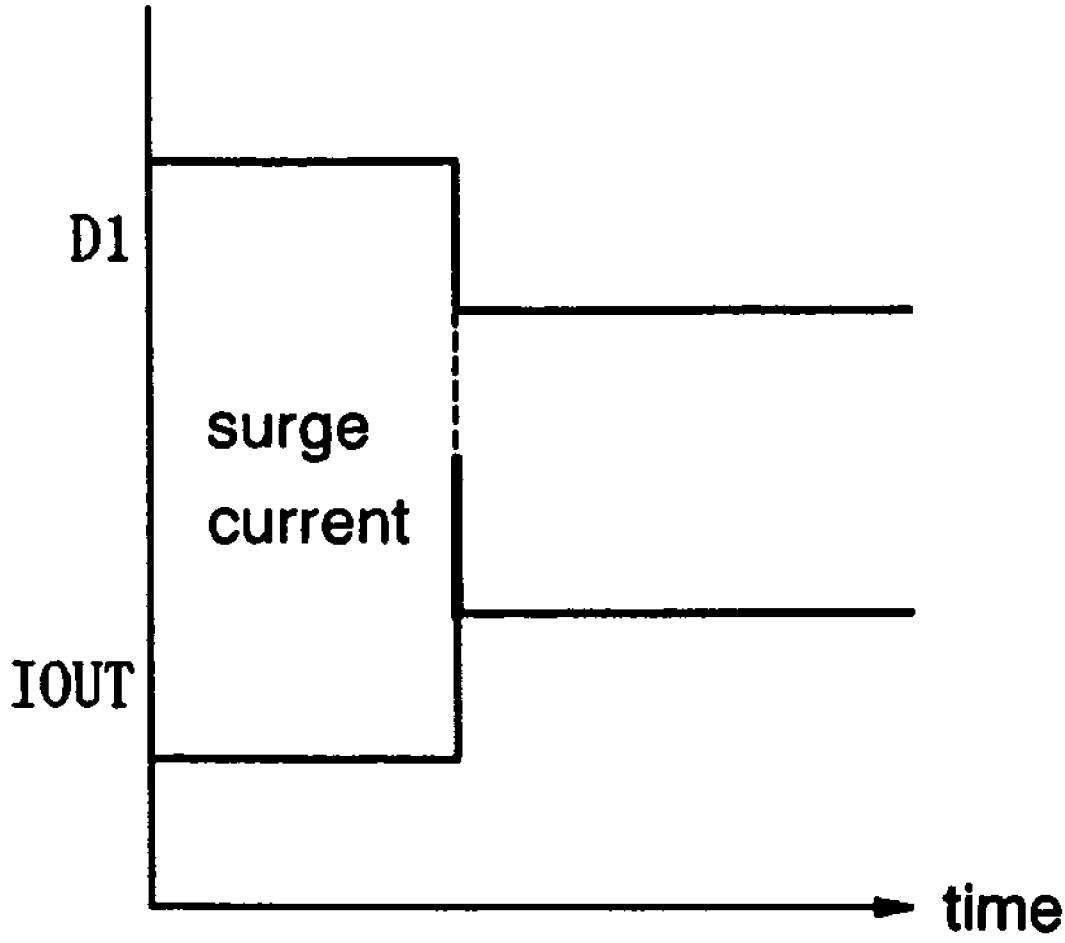
Fig. 2 (Prior Art)
FIG. 2 is an explanatory view of the operation of the current drive circuit of the prior art.
Figure 4:
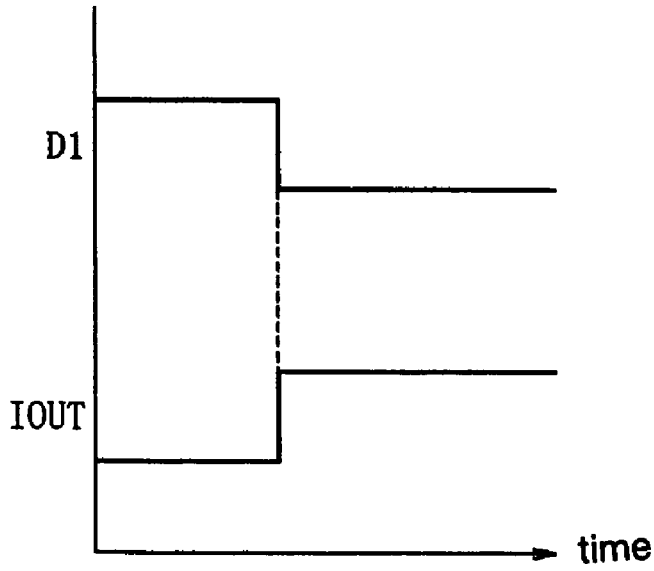
FIG. 4 is an explanatory view of the operation of the current drive circuit of the first embodiment of the present invention.

Although the difference in voltage between node A and node B of switch means SW1 when switch means SW1 is in the OFF state is substantially voltage VDD in the current drive circuit of the prior-art example that was shown in FIG. 1, in the current drive circuit of the present embodiment, VTH1 and VTH2 are very small values as shown in Equation 5, and it can be seen that these values can be set far lower than voltage VDD despite the appropriate setting of IREF. As a result, the surge current of drive current IOUT that is generated when switch means SW1 changes from the OFF state to the ON state can be suppressed, as shown in FIG. 4.

The configuration can also be modified such that p-channel MOS transistor M01, p-channel MOS transistor M02, p-channel MOS transistor M11, and p-channel MOS transistor M12 are all modified to n-channel MOS transistors and the high and low power supply voltages reversed, and switch means SW1 can be changed to an n-channel MOS transistor.

As described in the foregoing explanation, the adoption of a cascode current mirror circuit configuration according to the current drive circuit of the first embodiment of the present invention allows a highly accurate drive current IOUT to be obtained. In addition, the adoption of a configuration in which switch means SW1 is provided between p-channel MOS transistor M11 and p-channel MOS transistor M12 obtains the effect of enabling a suppression of the surge current of drive current IOUT that occurs when switch means SW1 changes from the OFF state to the ON state. Finally, the suppression of the surge current and the reduction of the time required for drive current IOUT to stabilize obtains the effect of enabling high-speed operation.

Figure 5:
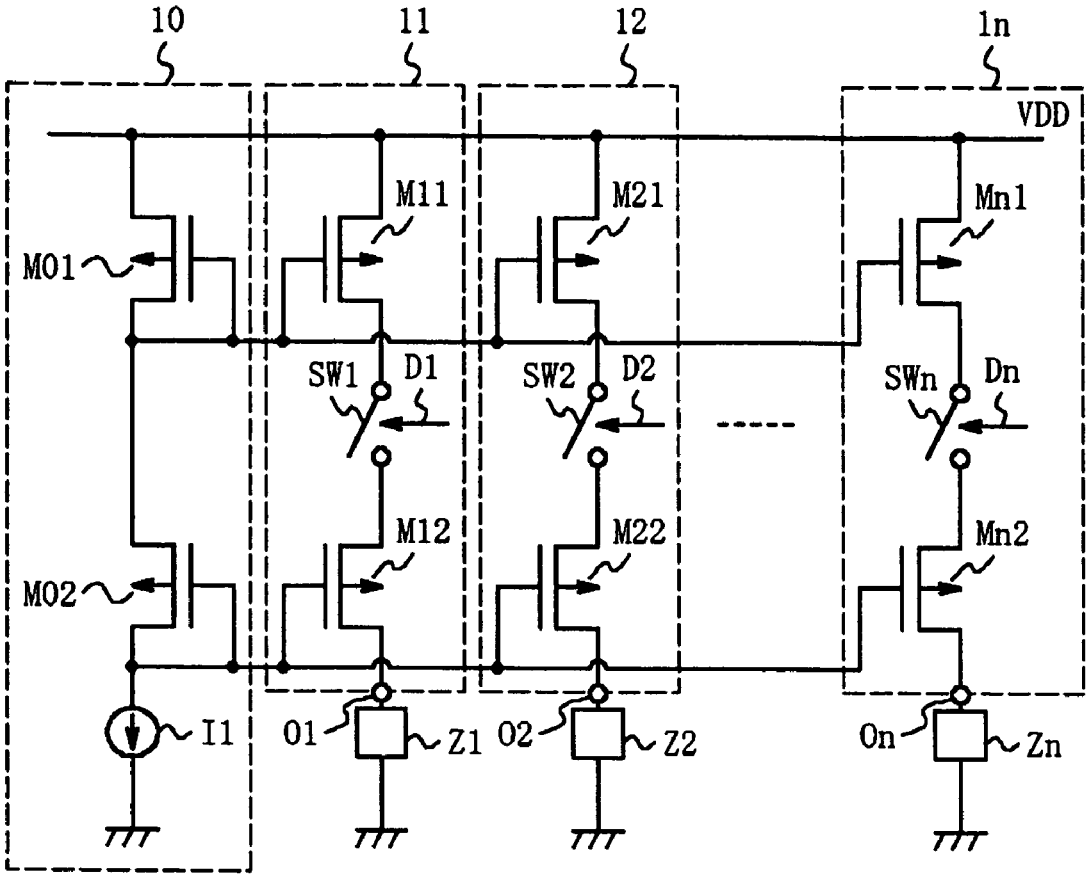
FIG. 5 is a circuit diagram of the current drive circuit of the second embodiment.

The configuration of the current drive circuit of the second embodiment of the present invention is next described with reference to FIG. 5. FIG. 5 is a circuit diagram of the current drive circuit of the second embodiment of the present invention. The only point of difference between the configuration of the current drive circuit of the second embodiment of the present invention shown in FIG. 5 and the configuration of the current drive circuit of the first embodiment of the present invention shown in FIG. 3 is the modification of providing a plurality of current output units to enable application to organic EL elements in matrix form in a display device, the other components being identical. Components that are the same in the configuration shown in FIG. 5 and the configuration shown in FIG. 3 are therefore identified by the same reference numerals, and redundant explanation of these identical elements is here omitted.

As shown in FIG. 5, the current drive circuit of the second embodiment of the present invention is provided with: bias generator 10; and n (n being a natural number equal to or greater than 2) current output units, from current output unit 11 and current output unit 12 up to current output unit 1*n*. Current output unit 12 is provided with: p-channel MOS transistor M21; switch means SW2; p-channel MOS transistor M22; and output terminal O2. The source terminal of p-channel MOS transistor M21 is connected to high level power supply VDD, and the gate terminal of p-channel MOS transistor M21 is connected to the gate terminal of p-channel MOS transistor M01. The gate terminal of p-channel MOS transistor M22 is connected to the gate terminal of p-channel MOS transistor M02, and the drain terminal of p-channel MOS transistor M22 is connected to output terminal O2. Switch means SW2 is provided between the drain terminal of p-channel MOS transistor M21 and the source terminal of p-channel MOS transistor M22. Switch means SW2 is consisted of, for example, a p-channel MOS transistor, the source-drain path of this p-channel MOS transistor serving as the ON/OFF path of switch means SW2, and the gate terminal of the p-channel MOS transistor being supplied with one-bit graduation data signal D2. Switch means SW2 is turned ON and OFF by graduation data signal D2, which is the ON/OFF control signal.

Organic EL element Z2 is connected as load between output terminal O2 and ground, organic EL element Z2 being illuminated when graduation data signal D2 becomes logic L level and switch means SW2 turns ON, and organic EL element Z2 being extinguished when graduation data signal D2 becomes the logic H level and switch means SW2 turns OFF.

Current output unit 1*n* is otherwise similarly provided with: p-channel MOS transistor Mn1, switch means SWn, p-channel MOS transistor Mn2, and output terminal On. The source terminal of p-channel MOS transistor Mn1 is connected to high level power supply VDD, and the gate terminal of p-channel MOS transistor Mn1 is connected to the gate terminal of p-channel MOS transistor M01. The gate terminal of p-channel MOS transistor Mn 2 is connected to the gate terminal of p-channel MOS transistor M02, and the drain terminal of p-channel MOS transistor Mn2 is connected to output terminal On. Switch means SWn is provided between the drain terminal of p-channel MOS transistor Mn1 and the source terminal of p-channel MOS transistor Mn2. Switch means SWn is consisted of, for example, a p-channel MOS transistor, the source-drain path of this p-channel MOS transistor serving as the ON/OFF path of switch means SWn, and one-bit graduation data signal Dn being applied to the gate terminal of this p-channel MOS transistor. Switch means SWn is turned ON and OFF by graduation data signal Dn, which is the ON/OFF control signal.

Organic EL element Zn is then connected between output terminal On and ground as load, organic EL element Zn being illuminated when graduation data signal Dn becomes logic L level and switch means SWn turns ON, and organic EL element Zn being extinguished when graduation data signal Dn becomes logic H level and switch means SWn is turned OFF.

As described in the preceding explanation, the current drive circuit of the second embodiment of the present invention can obtain the effect of enabling the simultaneous and individual drive of n organic EL elements from organic EL element Z1 and organic EL element Z2 to organic EL element Zn by means of a configuration in which the n current output units, from current output unit 11 and current output unit 12 to current output unit 1*n*, are caused to generate the same drive current from reference current source I1 of bias generator 10, and in which n bits of graduation data signals, from graduation data signal D1 and graduation data signal D2 to graduation data signal Dn, exercise ON/OFF control over switch means, from switch means SW1 and switch means SW2 to switch means SWn.

Figure 6:
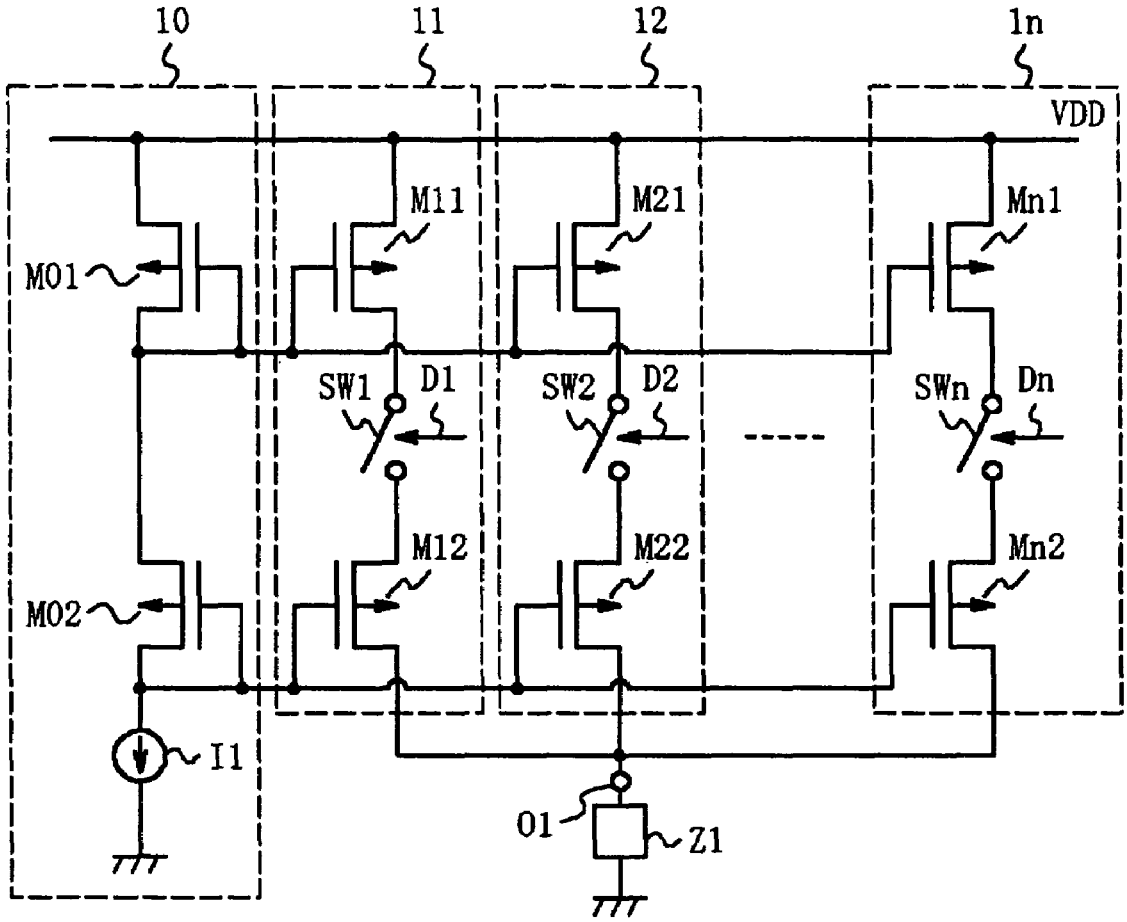
FIG. 6 is a circuit diagram of the current drive circuit of the third embodiment of the present invention.

Following explanation regards the configuration of the current drive circuit of the third embodiment of the present invention with reference to FIG. 6. FIG. 6 is a circuit diagram of the current drive circuit of the third embodiment of the present invention. The only point of difference between the configuration of the current drive circuit of the third embodiment of the present invention that is shown in FIG. 6 and the configuration of the current drive circuit of the second embodiment of the present invention that is shown in FIG. 5 is the modification whereby the output terminals of each of the n current output units, from current output unit 11 and current output unit 12 to current output unit 1*n*, are connected to a single output terminal O1. The components are otherwise identical, and the same reference numerals are therefore applied to identical components in the configuration shown in FIG. 6 and the configuration shown in FIG. 5, and redundant explanation regarding these components is here omitted.

As shown in FIG. 6, the drain terminals of each of n p-channel MOS transistors from p-channel MOS transistor M12 and p-channel MOS transistor M22 to p-channel MOS transistor Mn2 are connected in common to output terminal O1, and organic EL element Z1 is connected as load between output terminal O1 and ground. Graduation control can thus be exercised over the drive current of organic EL element Z1 by using the n current output units from current output unit 11 and current output unit 12 to current output unit 1*n*.

When the output currents of each of the n current output units, from current output unit 11 and current output unit 12 to current output unit 1*n*, are equal, a drive current can be obtained that enables n graduation variations by changing the number of switch means among the n switch means, from switch means SW1 and switch means SW2 to switch means SWn, that are turned ON by the n bits of graduation data signals, from graduation data signal D1 and graduation data signals D2 to graduation data signal Dn. In addition, binary weighting of the mirror ratio of the return currents of the n current output units, from current output unit 11 and current output unit 12 to current output unit 1*n*, enables the representation of the output current of each of the n current output units, from current output unit 11 and current output unit 12 to current output unit 1*n*, by:

$$2^{(i-1)} \cdot IREF$$

where i is a natural number equal to or less than n. A drive current can thus be obtained that is capable of 2^n graduation variations.

As described in the foregoing explanation, the current drive circuit of the third embodiment of the present invention has the effect of obtaining a drive current that allows n graduation variations and a drive current that allows 2^n graduation variations.

Figure 7:
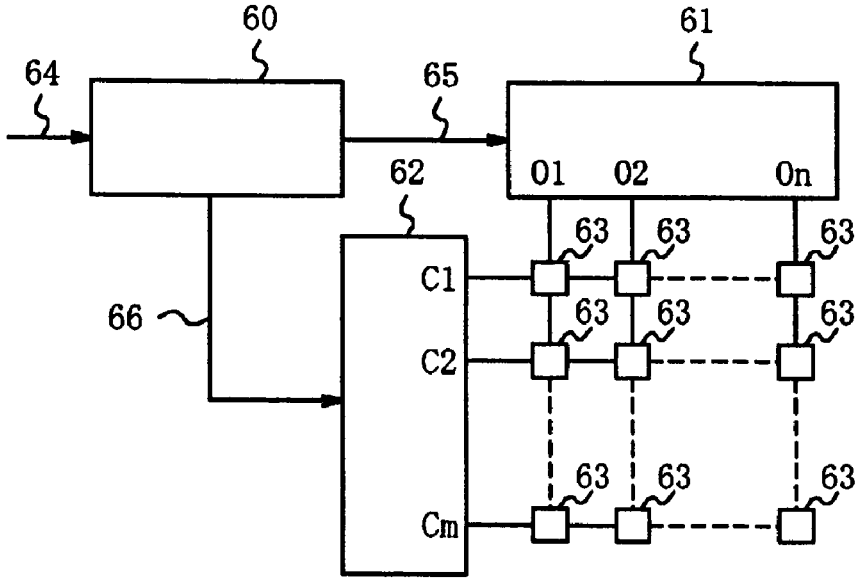
FIG. 7 is a circuit diagram of the display of the fourth embodiment of the present invention.

Following explanation regards the configuration of the display of the fourth embodiment of the present invention with reference to FIG. 7. FIG. 7 is a circuit diagram of the display of the fourth embodiment of the present invention. As shown in FIG. 7, the display of the fourth embodiment of the present invention is provided with: signal processing circuit 60, current drive circuit 61, scan circuit 62, and organic EL elements 63 that are arranged in matrix form in m (where m is a natural number equal to or greater than 2) rows and n (where n is a natural number equal to or greater than 2) columns. Signal processing circuit 60, upon input of a one-screen portion of image data signals 64, sequentially applies one-row portions of graduation data signals 65 to current drive circuit 61, and with each output of a one-row portion of graduation data signals 65, applies scan control signal 66 to scan circuit 62. Each of the n bits of graduation data signals 65 has a one-to-one correspondence to the n organic EL elements 63 in one row, and the illumination or darkening of corresponding organic EL elements 63 is designated by the logic level of each bit. Current drive circuit 61 is provided with n output terminals, from output terminal O1 to output terminal On, that have a one-to-one correspondence to each bit of graduation data signal 65, and a drive current flows from an output terminal to the positive electrode terminal of organic EL element 63 when the corresponding bit is logic L level, and drive current does not flow from an output terminal when the corresponding bit is logic H level. The n negative electrode terminals of one-row portions of organic EL elements 63 are connected in common to corresponding output terminals of scan circuit 62, from output terminal C1 to output terminal Cm; and ground level output is sequentially supplied as the low level power supply to one output terminal, from output terminal C1 to output terminal Cm, in accordance with scan control signals 66. Then, of the m rows and n columns of organic EL elements 63, those organic EL elements in which the drive current flows to the positive electrode terminals and the ground level is applied to the negative electrode terminals are illuminated, and the remaining organic EL elements 63 are extinguished.

Although a configuration is shown in the third embodiment in which a drive current that has been subjected to graduation control is supplied to a single organic EL element, the current drive circuit of the third embodiment may be provided for each of output terminals from output terminal O2 to output terminal On for application to the display of the fourth embodiment of the present invention.

The current drive circuit of the third embodiment of the present invention that was shown in FIG. 6 is applied in current drive circuit 61, and graduation data signals 65 become the n bits of graduation data signals, from graduation data signal D1 and graduation data signal D2 to graduation data signal Dn, that are shown in FIG. 6.

As described in the foregoing explanation, through the provision of the current drive circuits of the third embodiment of the present invention that supply a drive current in which the surge current is suppressed with both high accuracy and high speed, the display of the fourth embodiment of the present invention obtains the effect of enabling the realization of a display that is capable of high-speed display with high quality.

Figure 8:
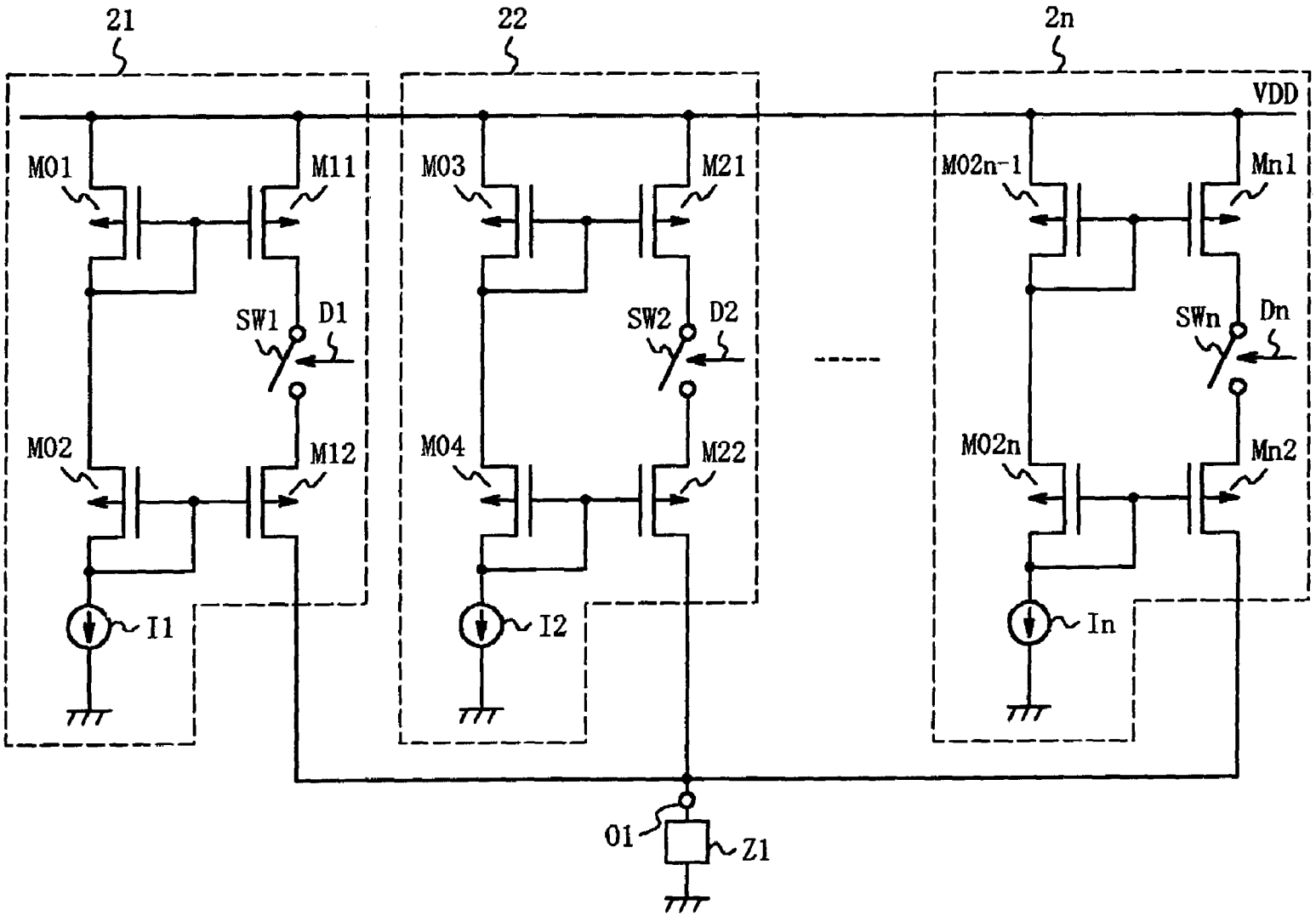
FIG. 8 is a circuit diagram of the current drive circuit of the fifth embodiment of the present invention.

Following explanation regards the configuration of the current drive circuit of the fifth embodiment of the present invention with reference to FIG. 8. FIG. 8 is a circuit diagram of the current drive circuit of the fifth embodiment of the present invention. The current drive circuit of the fifth embodiment of the present invention that is shown in FIG. 8 is provided with: n (where n is a natural number equal to or greater than 2) current drive circuits of the first embodiment of the present invention that was shown in FIG. 3, the output terminals of each of the n current drive circuits, from current drive circuit 21 and current drive circuit 22 to current drive circuit 2*n*, being connected to a single output terminal O1. Components in the configuration shown in FIG. 8 that are identical to components in the configuration shown in FIG. 3 are given the same reference numerals and redundant explanation is here omitted.

The configuration of the n current drive circuits, from current drive circuit 21 and current drive circuit 22 to current drive circuit 2*n*, is identical. In other words, the p-channel MOS transistors, from p-channel MOS transistor M01 and p-channel MOS transistor M03 up to p-channel MOS transistor M02*n*−1, are identical; the p-channel MOS transistors from p-channel MOS transistor M11 and p-channel MOS transistor M21 up to p-channel MOS transistor Mn1 are identical; the p-channel MOS transistors from p-channel MOS transistor M02 and p-channel MOS transistor M04 up to p-channel MOS transistor M02*n* are identical; the p-channel MOS transistors from p-channel MOS transistor M12 and p-channel MOS transistor M22 up to p-channel MOS transistor Mn2 are identical; the reference current sources from reference current source I1 and reference current source 12 up to reference current source In are identical; and the switch means from switch means SW1 and switch means SW2 up to switch means SWn are identical.

As shown in FIG. 8, each of the drain terminals of the n p-channel MOS transistors, from p-channel MOS transistor M12 and p-channel MOS transistor M22 up to p-channel MOS transistor Mn2, are connected in common to output terminal O1; and organic EL element Z1 is connected as load between output terminal O1 and ground. The n current drive circuits, from current drive circuit 21 and current drive circuit 22 up to current drive circuit 2*n*, can be used to realize graduation control of the drive current of organic EL element Z1.

Although a configuration has been shown in the present embodiment in which drive currents that have undergone graduation control are supplied in common to a single organic EL element, the current drive circuits of the present embodiment should be provided for each of output terminals from output terminal O2 to output terminal On for application to the display of the third embodiment of the present invention.

When the output currents of each of the n current drive circuits, from current drive circuit 21 and current drive circuit 22 up to current drive circuit 2*n*, are equal, a drive current can be obtained that enables n graduation variations by changing the number of switch means among the n switch means, from switch means SW1 and switch means SW2 to switch means SWn, that are turned ON by the n bits of graduation data signals from graduation data signal D1 and graduation data signals D2 to graduation data signal Dn. In addition, binary weighting of the constant-current value of the n current drive circuits, from current drive circuit 21 and current drive circuit 22 up to current drive circuit 2*n*, enables the representation of the weighted output current of each of the n current drive circuits, from current drive circuit 21 and current drive circuit 22 up to current drive circuit 2*n*, by:

$$2^{(i-1)}\cdot IREF$$

where i is a natural number equal to or less than n. A drive current can thus be obtained that is capable of 2^n graduation variations.

As described in the foregoing explanation, the current drive circuit of the fifth embodiment of the present invention has the effect of obtaining a drive current that allows n graduation variations and a drive current that allows 2^n graduation variations.

Figure 9:
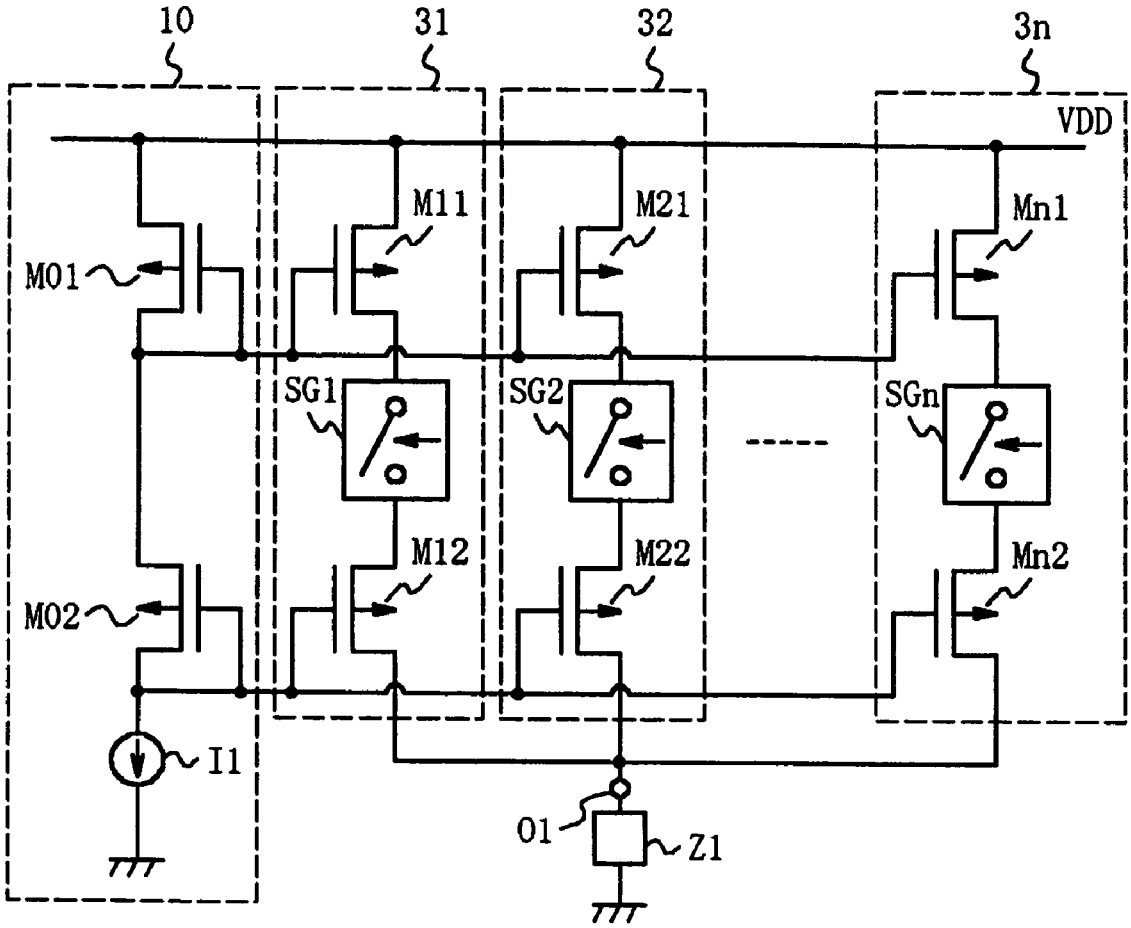
FIG. 9 is a circuit diagram of the current drive circuit of the sixth embodiment of the present invention.
Figures 10, 11:
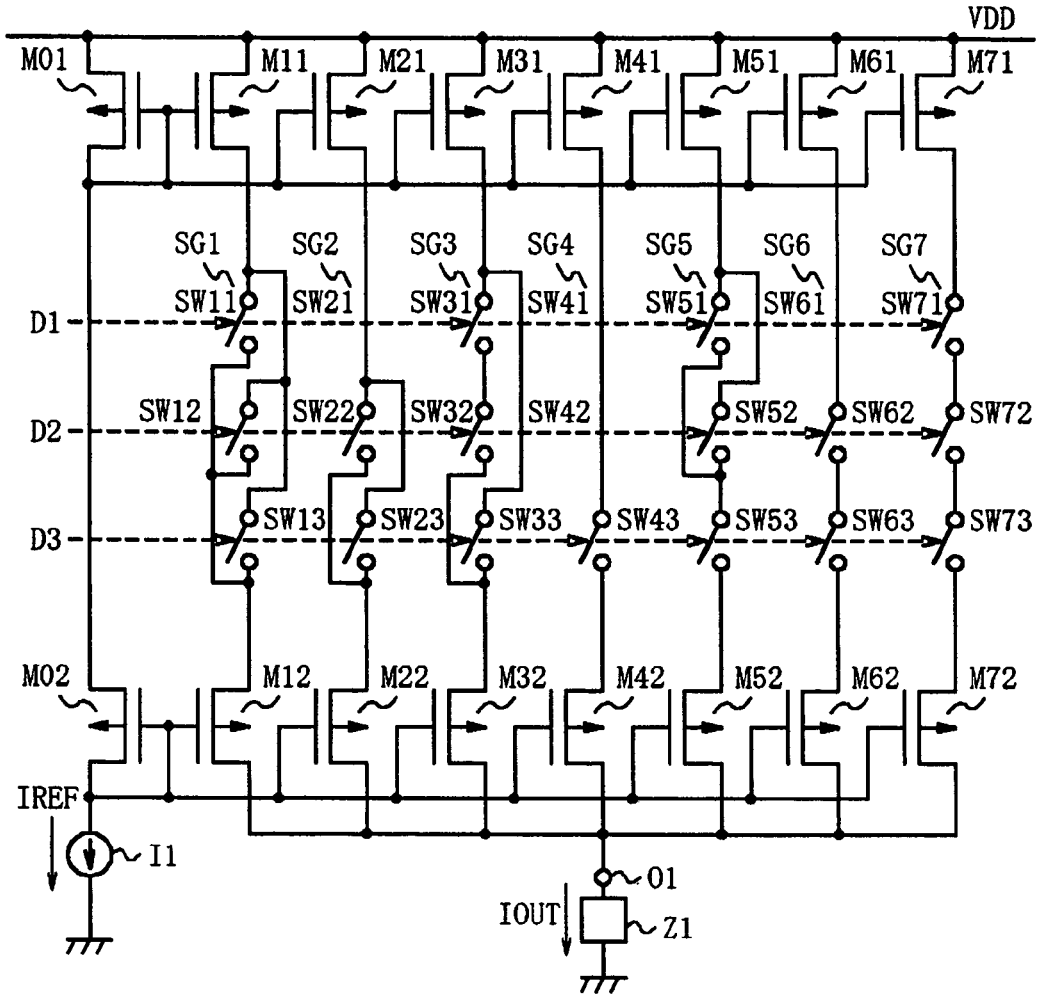
FIG. 10 is a detailed circuit diagram of FIG. 9.
FIG. 11 is an explanatory view of the decoding operation of FIG. 10.

Following explanation regards the configuration of the current drive circuit of the sixth embodiment of the present invention with reference to FIGS. 9, 10, and 11. FIG. 9 is a circuit diagram of the current drive circuit of the sixth embodiment of the present invention, FIG. 10 is a detailed view of the circuit diagram of FIG. 9, and FIG. 11 is an explanatory view of the decoding operation of FIG. 10. The only points of difference between the configuration of the current drive circuit of the sixth embodiment of the present invention that is shown in FIG. 9 and the configuration of the current drive circuit of the fourth embodiment of the present invention that is shown in FIG. 7 are the modification of the n switch means, from switch means SW1 and switch means SW2 up to switch means SWn, to n switch groups, from switch group SG1 and switch group SG2 up to switch group SGn, that each include a plurality of switch means; and the modification of the n current output units, from current output unit 11 and current output unit 12 to current output unit 1*n*, to n current output units, from current output unit 31 and current output unit 32 to current output unit 3*n*. The components are otherwise identical, and components shown in FIG. 9 that are identical to components shown in FIG. 7 are therefore identified by the same reference numerals and redundant explanation is here omitted.

The current drive circuit of the fourth embodiment of the present invention that is shown in FIG. 7 is provided with only one switch means for each of the n current output units, from current output unit 11 and current output unit 12 up to current output unit 1*n*. As a consequence, in a case in which the output currents of each of the n current output units, from current output unit 11 and current output unit 12 up to current output unit 1*n*, are equal and n graduation control is to be implemented, and when the graduation data signals, from graduation data signal D1 and graduation data signal D2 up to graduation data signal Dn, are binary code of n bits, an external decoder is required for placing the graduation data signals, from graduation data signal D1 and graduation data signal D2 up to graduation data signal Dn, in correspondence with the switch means, from switch means SW1 and switch means SW2 up to switch means SWn. To eliminate the need for this decoder, the present embodiment is provided with switch groups, from switch group SG1 and switch group SG2 up to switch group SGn, for decoding the graduation data signals, from graduation data signal D1 and graduation data signal D2 up to graduation data signal Dn.

A more detailed explanation is presented using FIG. 10 and FIG. 11. As the details of a specific example of the configuration of the switch groups of FIG. 9, from switch group SG1 and switch group SG2 up to switch group SGn, FIG. 10 shows a configuration in which seven current output units are controlled by three bits of graduation data signals, graduation data signal D1, graduation data signal D2, and graduation data signal D3. FIG. 11 shows the relation between the graduation data signals, switch means that are ON, and drive current IOUT.

Switch group SG1 is provided with switch means SW11, switch means SW12, and switch means SW13 that are parallel-connected, both ends of switch means SW11 being connected between the drain terminal of p-channel MOS transistor M11 and the source terminal of p-channel MOS transistor M12. Switch group SG2 is provided with: switch means SW21 that is always in the ON state, and switch means SW22 and switch means SW23 that are parallel connected to each other and serially connected to switch means SW21; one end of switch means SW21 and one end of switch means SW22 being connected between the drain terminal of p-channel MOS transistor M21 and the source terminal of p-channel MOS transistor M22.

Switch group SG3 is provided with switch means SW33, and switch means SW31 and switch means SW32 that are parallel connected to switch means SW33, these two switch means SW31 and switch means SW32 being serially connected, and both ends of switch means SW33 being connected between the drain terminal of p-channel MOS transistor M31 and the source terminal of p-channel MOS transistor M32.

Switch group SG4 is provided with serially connected switch means SW41 that is always in the ON state, switch means SW42 that is always in the ON state, and switch means SW43; one end of switch means SW41 and one end of switch means SW43 being connected between the drain terminal of p-channel MOS transistor M41 and the source terminal of p-channel MOS transistor M42.

Switch group SG5 is provided with switch means SW53, and switch means SW51 and switch means SW52 that are parallel connected to each other and serially connected to switch means SW53; one end of switch means SW51 and one end of switch means SW53 being connected between the drain terminal of p-channel MOS transistor M51 and the source terminal of p-channel MOS transistor M52.

Switch group SG6 is provided with serially connected switch means SW61 that is always in the ON state, switch means SW62, and switch means SW63; one end of switch means SW61 and one end of switch means SW63 being connected between the drain terminal of p-channel MOS transistor M61 and the source terminal of p-channel MOS transistor M62.

Switch group SG7 is provided with serially connected switch means SW71, switch means SW72, and switch means SW73; one end of switch means SW71 and one end of switch means SW73 being connected between the drain terminal of p-channel MOS transistor M71 and the source terminal of p-channel MOS transistor M72. In the above-described configuration, switch means that are always in the ON state can be omitted.

Switch means SW11, switch means SW31, switch means SW51, and switch means SW71 are subjected to ON/OFF control by graduation data signal D1, which is the LSB of three bits; switch means SW12, switch means SW22, switch means SW32, switch means SW52, switch means SW62, and switch means SW72 are subjected to ON/OFF control by graduation data signal D2; and switch means SW13, switch means SW23, switch means SW33, switch means SW43, switch means SW53, switch means SW63, and switch means SW73 are subjected to ON/OFF control by graduation data signal D3, which is the MSB of three bits.

As shown in FIG. 11, when graduation data signal D1, graduation data signal D2, and graduation data signal D3, which are a three-bit binary code, are changed from (000) to (111) by means of the above-described configuration, drive current IOUT, which takes the constant-current IREF of reference current source I1 as a variable step, can be obtained from 0 to 7 IREF. For the sake of convenience, a case was shown in FIG. 11 in which the switch means was ON when the graduation data signal was logic 1, but logic 1 corresponds to logic level L when the switch means is consisted of a p-channel MOS transistor. In addition, although a configuration was shown in FIG. 10 in which seven current output units are controlled by three bits, i.e., graduation data signal D1, graduation data signal D2, and graduation data signal D3, it is extremely easy to provide n switch groups, from switch group SG1 and switch group SG2 up to switch group SGn, that each include a plurality of switch means, and to expand to n current output units, from current output unit 31 and current output unit 32 to current output unit 3*n*.

It should be clear that the configuration of switch groups from switch group SG1 and switch group SG2 up to switch group SGn can be applied to the configuration of current drive circuit of the fifth embodiment of the present invention that is shown in FIG. 8.

As described in the foregoing explanation, by adopting a configuration that is provided with switch groups from switch group SG1 and switch group SG2 up to switch group SGn for carrying out a decoding operation, the current drive circuit of the sixth embodiment of the present invention obtains the effect of enabling n-graduation control by direct linking even when the graduation data signals, from graduation data signal D1 and graduation data signal D2 up to graduation data signal Dn, are binary codes of n bits.

Figure 12:
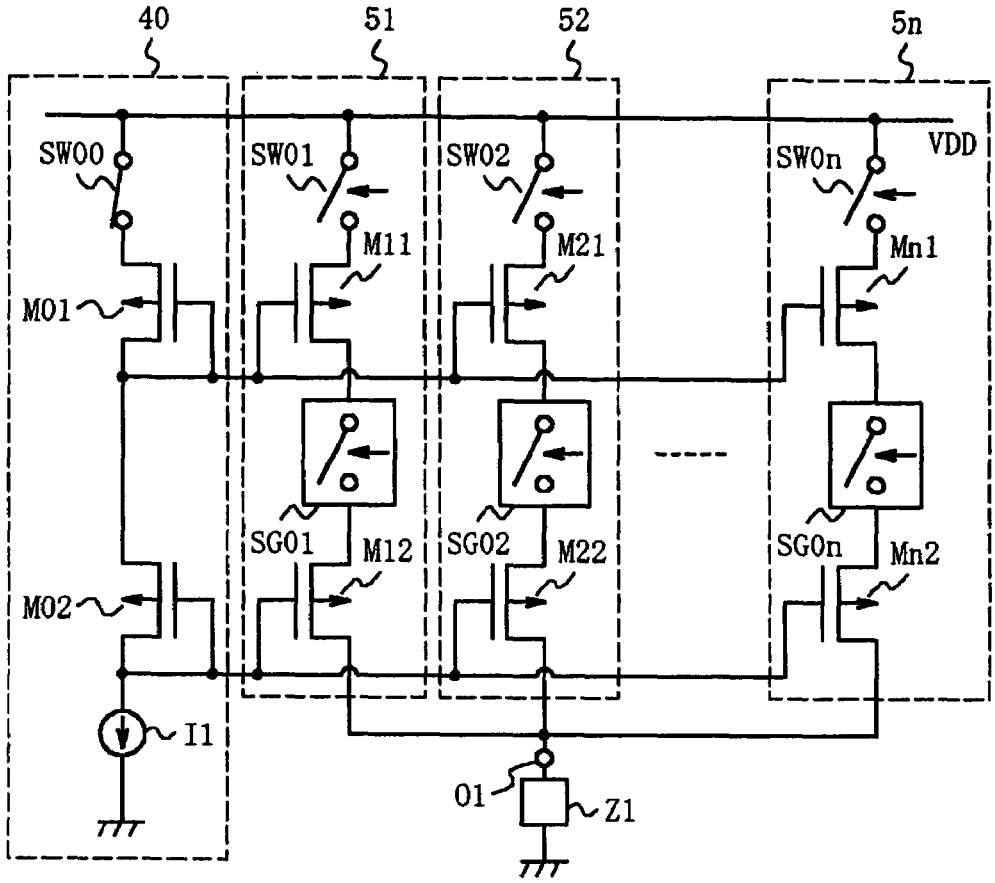
FIG. 12 is a circuit diagram of the current drive circuit of the seventh embodiment of the present invention.

Following explanation regards the configuration of the current drive circuit of the seventh embodiment of the present invention with reference to FIG. 12. FIG. 12 is a circuit diagram of the current drive circuit of the seventh embodiment of the present invention. As the only point of difference between the configuration of the current drive circuit of the seventh embodiment of the present invention shown in FIG. 12 and the configuration of the current drive circuit of the sixth embodiment of the present invention shown in FIG. 9, in each switch group of the n switch groups from switch group SG1 and switch group SG2 up to switch group SGn that each include a plurality of switch means, one portion of the switch means that are included in switch groups and that are connected together in a series is shifted to the source side of a p-channel MOS transistor of the current mirror circuit to which its switch group is connected. The two configurations are otherwise identical, and components that are identical in the configuration shown in FIG. 12 and in the configuration shown in FIG. 9 are therefore identified by the same reference numerals and redundant explanation is here omitted.

Bias generator 40 is a configuration in which switch means SW00 is connected between high level power supply VDD and the source terminal of p-channel MOS transistor M01 of bias generator 10 that is shown in FIG. 9; current output unit 51 is a configuration in which switch means SW01 is connected between high level power supply VDD and the source terminal of p-channel MOS transistor M11 of current output unit 31 that is shown in FIG. 9; current output unit 52 is a configuration in which switch means SW02 is connected between high level power supply VDD and the source terminal of p-channel MOS transistor M21 of current output unit 32 shown in FIG. 9; and current output unit 5*n* is a configuration in which switch means SW0*n* is connected between high level power supply VDD and the source terminal of p-channel MOS transistor Mn1 of current output unit 3*n* shown in FIG. 9. Switch means SW00 that is always ON in bias generator 40 is provided for connecting the same ON resistance (the resistance across the source and drain of a p-channel MOS transistor) as the ON resistance (the resistance across the source and drain of the p-channel MOS transistor) of switch means from switch means SW01 and switch means SW02 up to switch means SW0*n* in order to realize highly accurate current mirror operation.

Because a portion of the switch means has been removed, the n switch groups from switch group SG1 and switch group SG2 up to switch group SGn are modified to n switch groups from switch group SG01 and switch group SG02 up to switch group SG0n.

According to the configuration shown in FIG. 10, n=7, whereby, for example, switch means SW11, switch means SW12, and switch means SW13 that are connected together in parallel are switch means SW01; switch means SW21 that is always in the ON state is switch means SW02; and switch means SW71 is switch means SW07.

As described in the foregoing explanation, the current drive circuit of the seventh embodiment of the present invention obtains the same effect as the current drive circuit of the sixth embodiment of the present invention.

While preferred embodiments of the present invention have been described using specific terms, such description is for illustrative purposes only, and it is to be understood that changes and variations may be made without departing from the spirit or scope of the following claims.

What is claimed is:

1. A display, comprising:

organic EL elements that are arranged in a matrix;

current drive circuits and scan circuits for causing drive currents to flow to said organic EL elements, wherein the current drive circuit comprises:

a current mirror circuit;

a current source for applying reference current input to said current mirror circuit;

a switch means to which output current of said current mirror circuit is applied; and a cascode circuit for supplying the output current of said switch means as a drive current.

2. A current drive circuit comprising:

a bias generator that includes:

a first transistor in which a gate terminal and a drain terminal are connected together;

a second transistor in which a source terminal is connected to said drain terminal of said first transistor and a gate terminal and a drain terminal are connected together; and a current supply that causes a reference current to flow to said second transistor; and a current output unit that includes:

a third transistor in which a gate terminal is connected to said gate terminal of said first transistor;

a fourth transistor in which a gate terminal is connected to said gate terminal of said second transistor; and a switch means that is provided between a drain terminal of said third transistor and a source terminal of said fourth transistor.

3. A current drive circuit according to claim 2, further comprising:

a plurality of said current output units; and a plurality of terminals that are connected to each of drain terminals of said fourth transistors of said plurality of said current output units.

4. A current drive circuit according to claim 3, wherein each of said plurality of said current output units supplies as output a current that has been weighted.

5. A current drive circuit comprising:

a plurality of current drive circuits according to claim 2; and a terminal that is connected to drain terminals of each of said fourth transistors of said plurality of said current drive circuits.

6. A current drive circuit according to claim 5, wherein each of said plurality of said current drive circuits supplies as output a current that has been weighted.

7. A current drive circuit according to claim 1, wherein said switch means is turned ON and OFF by a control signal.

8. A current drive circuit according to claim 2, wherein said switch means is turned ON and OFF by a control signal.

9. A current drive circuit according to claim 7, wherein said control signal is a graduation data signal of a display.

10. A current drive circuit according to claim 8, wherein said control signal is a graduation data signal of a display.

11. A current drive circuit according to claim 1, wherein said switch means is a MOS transistor.

12. A current drive circuit according to claim 2, wherein said switch means is a MOS transistor.

13. A current drive circuit according to claim 3, wherein said switch means is a switch group that includes a plurality of switch means, and said switch group decodes graduation data signals of a display.

14. A current drive circuit according to claim 5, wherein said switch means is a switch group that includes a plurality of switch means, and said switch group decodes graduation data signals of a display.

15. A current drive circuit according to claim 13, comprising a switch means that is connected to a source terminal of said third transistor.

16. A current drive circuit according to claim 14, comprising a switch means that is connected to a source terminal of said third transistor.

17. A current drive circuit according to claim 15, comprising a switch means that is connected to a source terminal of said first transistor and that is always in an ON state.

18. A current drive circuit according to claim 16, comprising a switch means that is connected to a source terminal of said first transistor and that is always in an ON state.

19. A display, comprising:

organic EL elements that are arranged in a matrix;

current drive circuits and scan circuits for causing drive currents to flow to said organic EL elements; and signal processing circuits for receiving image data signals as input, supplying graduation data signals to said current drive circuits, and supplying scan control signals to said scan circuits; and wherein said display is provided with a current drive circuit comprising:

a current mirror circuit;

a current source for applying reference current input to said current mirror circuit;

a switch means to which output current of said current mirror circuit is applied; and a cascode circuit for supplying the output current of said switch means as a drive current.

20. A display, comprising:

organic EL elements that are arranged in a matrix;

current drive circuits and scan circuits for causing drive currents to flow to said organic EL elements; and signal processing circuits for receiving image data signals as input, supplying graduation data signals to said current drive circuits, and supplying scan control signals to said scan circuits; and wherein said display is provided with the current drive circuit of claim 2 as said current drive circuit.

* * * * *